United States Patent [19]

Bannigan, Jr.

[11] 4,253,843

[45] Mar. 3, 1981

[54] METHOD FOR IMPROVING THE LIGHT FASTNESS OF NYLON DYEINGS USING COPPER PHOSPHATE

[75] Inventor: Vincent W. Bannigan, Jr., Pottstown, Pa.

[73] Assignee: Crompton & Knowles Corporation, New York, N.Y.

[21] Appl. No.: 33,202

[22] Filed: Apr. 25, 1979

[51] Int. Cl.[3] ..... D06P 5/02; D06P 5/10

[52] U.S. Cl. ..... 8/624; 8/442

[58] Field of Search ..... 8/165, 74, 82, 442, 8/624; 428/267

[56] References Cited

U.S. PATENT DOCUMENTS

| | | | |
|---|---|---|---|
| 2,206,278 | 7/1940 | Dreyfus | 8/165 |
| 3,332,732 | 7/1967 | Karoly | 8/165 |

FOREIGN PATENT DOCUMENTS

| | | | |
|---|---|---|---|
| 43-20969 | 9/1968 | Japan | 8/165 |

*Primary Examiner*—Joseph L. Schofer
*Assistant Examiner*—Maria Parrish Tungol
*Attorney, Agent, or Firm*—William H. Elliott, Jr.; Synnestvedt & Lechner

[57] ABSTRACT

The specification is directed to a method for enhancing the light fastness of dyed and undyed nylon textile fibers and to the treated fibers produced thereby. The beneficial effect is obtained by applying at least 3 parts per million colloidal phosphate to the fiber by exhaustion from an aqueous medium; the treatment being effected either before dyeing, simultaneously with or after the dye has been applied to the fiber.

19 Claims, No Drawings

METHOD FOR IMPROVING THE LIGHT FASTNESS OF NYLON DYEINGS USING COPPER PHOSPHATE

This invention relates to a method for enhancing the light fastness of dyed nylon textile fibers.

Heretofore, it has been known to improve the light fastness of dyed nylon fabrics by treating the fibers with aqueous solutions containing copper in the form of cupric ion. The copper was applied as a water soluble copper salt, usually copper sulfate or copper acetate that was added directly to the dyebath and deposited on the fiber simultaneously with the dye. But because the copper is in soluble form and has very poor affinity for the nylon, the deposited copper can be easily washed off the fiber in the normal wet treatments to which fibers are subjected in processing. This results in uneven distribution of the copper on the fiber and its impact on light fastness will not be uniform.

In addition, because of its high solubility the use of the soluble copper salts give rise to effluent problems in disposing of spent dyebath liquors and the water used in washing the dyed fabric. Moreover, when soluble copper salts are added to the dye baths, in many commonly used dyeing processes, the pH conditions during the dyeing cycle are such that the copper will precipitate as copper hydroxide, which, in turn, will be converted to copper oxide when elevated temperatures are employed to accelerate the exhaustion and fixation of the dye on the fiber. Copper oxide objectionably discolors the dyed nylon (imparting a black or brown coloration thereto), does not exhaust in a level manner and frequently "builds up" on and contaminates the dyeing vessel.

For these reasons, the practice of adding soluble copper to enhance light fastness has not heretofore gained widespread acceptance by dyers.

It is an object of this invention to provide a method for applying copper to nylon in a form that will not cause discoloration of the dyed fibers due to copper oxide formation that can be substantially fully exhausted onto the fiber in a level manner under the dyeing conditions prevailing in the normal dyeing cycle and that minimizes the effluent disposal problems.

These objects and advantages are obtained in accordance with this invention by exhausting copper phosphate—preferably in colloidal form—onto the nylon textile fibers so as to deposit on and beneath the surface of the fibers at least three parts per million of copper phosphate based on the fiber weight; this in addition to any copper that may have been incorporated in the fiber during manufacture or predyeing processing. The deposition of the copper phosphate can be effected either before dyeing, simultaneously with the dyeing or after the dye has been applied to the fiber.

By this invention, it has been found that copper phosphate has solubility characteristics much like that of many disperse dyes and can be exhausted onto nylon fiber in the same manner as a disperse dyestuffs. The exhaustion can be accomplished by any of the conventional dyeing techniques—either from organic solvent systems, from aqueous dispersions of the copper phosphate or from aqueous dyebaths that contain the copper phosphate.

In the preferred practice of the invention; about 750 to 1500 parts per million (based on the fiber weight) copper phosphate should be exhausted onto the fibers.

Where less than three parts per million of copper phosphate are deposited in and on the fiber, the exhaustion level will not be uniform under the conditions prevailing in conventional dyeing operations, and the effect on the light fastness of the dyeings tend to be inconsistent as to different areas of the same piece of treated fabric. Where more than about 7500 parts per million copper are exhausted onto the fibers, the saturation point of the fiber for the copper phosphate will be approached, the fiber will be objectionably tinted in bluish hues and the copper concentration in the bath will build up to a point where a colored effluent results that will give rise to accute disposal problems.

The copper phosphate can be added to the bath as a very finely ground powder, but to provide level exhaustion, it is preferred to form the copper phosphate in situ in the treatment bath by adding a solution containing divalent copper ions and phosphate ions, either separately or in combination, and thereafter raising the pH of the treating bath to above 4.5 thereby precipitating colloidal copper phosphate. In most conventional nylon dyeing processes, the pH conditions necessary to form colloidal copper phosphate will exist during at least part of the dyeing cycle. At pHs above about 11 copper oxide formation can become a problem.

In beam and package dyeing of nylon, it is important that the copper phosphate be in solution and caused to be distributed throughout the beam or package before the the colloid is formed. If it is in colloidal form (such as will be the case where it is added as the aqueous dispersion formed by mixing soluble copper salts and alkali phosphates, such as tri, di or mono sodium phosphate) in the initial stages of application or exhaustion on the beam, the insoluble material will deposit on the innermost wraps and "plugging of the beam" can result. In such application, beam plugging can be avoided by adding the copper phosphate as a true solution.

Thus, in the preferred practice of the invention, the copper phosphate is added to the bath in the form of an aqueous stock solution of copper phosphate in a stoichiometric excess of orthophosphoric acid. The excess orthophosphoric acid should be sufficient to insure complete solution of the copper phosphate in the bath at the time it is introduced therein, but the excess need not be great. Very good results have been obtained by adding a solution containing sufficient orthophosphoric acid to insure that the pH of the bath will be less than the point at which colloidal copper phosphate forms—i.e. below about 4.5 during the initial stages of the dyeing cycle.

The concentration of the copper phosphate in the system or bath can vary over a wide range, but in normal cases where the copper phosphate solution is not deemed critical for purposes of this invention so long as sufficient copper phosphate is present to provide the desired 3 to 7500 ppm copper phosphate on the fibers.

In order to cause adherence or fixation of the copper phosphate, it is important in accordance with the process of the invention to carry out the treatment in a way that will insure the penetration of the colloidal copper beneath the surface of the fiber. If it is merely deposited on the surface, it can be readily stripped off and its benefits lost. Many conventional dyeing techniques will bring about penetration of the copper phosphate particularly where the processing is carried out under conditions whereby the fibers are in a swollen condition during the exhaustion operation thereby providing easier access to the interior portions thereof. Swelling can be accomplished by applying the copper phosphate from an aqueous bath at elevated temperatures approaching the boil. Where the copper phosphate is applied from an aqueous bath, good penetration can also be obtained by heating or otherwise applying energy to the wetted fibers.

The dyes that can be used in connection with this process are the dyes that are capable of dyeing nylon and modified nylon fibers. Depending on the dye receptivity of the nylon being treated, both anionic and cationic dyes can be used. The so called acid dyes and the premetalized acid dyes are particularly well suited where unmodified nylons are involved. Almost every dye that has been tested to date with the process of this invention has been found to provide dyeings with improved light fastness as compared to that of dyeings that do not contain copper phosphate. However, because of the nature of the copper phosphate solution that is added to the bath, it is usually considered advisable to use a dye that is not readily chelatable.

The following represent a few of the many dyes whose dyeings have been found to generally exhibit a rise in light fastness of from one half a point to three points on the grey scale when treated in accordance with the teachings of this invention: C.I. Acid Yellow 128, 129 and 151; C.I. Acid Orange 60, 86 and 87; C.I. Acid Red 182, 211, 213 and 278; C.I. Acid Blue 62, 171 and 290; C.I. Acid Black 131 and 132; C.I. Acid Brown 19 and 282; C.I. Acid Green 25.

The following examples will serve to illustrate the treatment of nylon in accordance with this invention. In these examples, unless otherwise indicated, parts are by weight, temperatures are given in degrees Fahrenheit and percentages are by weight.

The dyeings of Examples 1 and 3 are controls and are free of deposited copper phosphate.

The dyeings of Example 2 and 4 contained 0.15% copper phosphate and were prepared by adding a copper phosphate stock solution (made by dissolving 20 g $CuSO_45H_2O$ in 12.3 g $H_3PO_4$ (85%) and sufficient water to make 1 liter) to the dye bath. Thereafter, the pH of the bath was raised to about 9 by the addition of alkali to form the colloid.

The general procedure followed in all examples involved:

Dyebath liquor: fabric ratio 30:1

All percentages based on weight of nylon fabric (O.W.F.).

Nylon fabric—40 denier, dull nylon 6, knit.

Dyebaths were prepared as shown in TABLE I to provide 0.1% dyeings and had a pH of about 9. The fabric was entered at 70° F., raised to 210° F. at 5°-6° F./minute, continued at 210° F. for 60 minutes, cooled at 140° F., rinsed in cool water and dried.

Light fastness tests were conducted on the dyeings by General Motors Test Method, TM 30-2 (Oct. 20, 1977) IIB—"Weatherometer Method"—twin arc Weatherometer, Atlas Electric Devices Company. Color change is expressed in color difference units evaluated visually, compared to the grey scale (I.S.O. International Standard R105/1) available from A.A.T.C.C.; a rating of 5 indicates no detectable color change and a rating of 1 indicates most severe color change.

TABLE I

| Example | Dye | %Copper Phosphate | Light Fastness (Weatherometer) 100 hrs. | 200 hrs. |
|---|---|---|---|---|
| 1 | Acid Yellow 151 | 0 | 3 | 1 |
| 2 | Acid Yellow 151 | 0.15 | 4-5 | 4 |
| 3 | Acid Blue 62 | 0 | 3 | 1 |
| 4 | Acid Blue 62 | 0.15 | 4-5 | 3 |

I claim:

1. The method of improving the light fastness of dyed nylon textile fibers which method comprises exhausting copper phosphate onto the fibers from a solvent system or from an aqueous bath and depositing on the fiber at least 3 parts per million copper phosphate based on the fiber weight; the deposition of the copper phosphate being effected before, simultaneously with or after the dye has been applied to the fibers.

2. The method of improving the light fastness of dyed nylon textile fibers dye which method comprises exhausting copper phosphate onto the fibers from an aqueous bath and depositing on the fiber at least 3 parts per million copper phosphate based on the fiber weight; the deposition of the copper phosphate being effected before, simultaneously with or after the dye has been applied to the fibers.

3. The method according to claim 1 or 2 wherein from about 3 to 7500 parts per million copper phosphate are exhausted onto the fibers.

4. The method according to claim 1 or 2 wherein about 750 to 1500 parts per million copper phosphate are exhausted onto the fibers.

5. The method according to claim 1 or 2 wherein the exhausting of the copper phosphate is carried out under pressure and at elevated temperatures below the boiling point of the bath or system at the prevailing pressure.

6. The method according to claim 1 or 2 wherein the exhausting of the copper phosphate is carried out from a solvent system or from an aqueous bath maintained at elevated temperatures approaching the boiling point of the system or bath.

7. The method according to claim 2 wherein the copper phosphate is applied by passing the textile fibers through an aqueous bath containing the copper phosphate and after the fibers have passed through the bath subjecting heating the wetted fibers under time and temperature conditions.

8. The method according to claim 2 wherein the copper phosphate is applied by passing the textile fibers through an aqueous bath containing the copper phosphate and after the fibers have passed through the bath subjecting them to steaming for a sufficient time to cause the copper phosphate to penetrate beneath the surface of the fibers.

9. The method according to any of claims 1 to 8 wherein the fibers undergoing treatment are undyed.

10. The method according to any of claims 1 to 8 wherein the fibers have been dyed prior to the depositing of the copper phosphate thereon.

11. The method according to any of claims 1 to 8 wherein the solvent system or aqueous copper phosphate bath also contains a dye capable of dyeing the nylon fibers undergoing treatment.

12. The method according to any of claims 1 to 10 wherein the pH of the bath is sufficiently high that the copper phosphate exhausted onto the nylon fibers is in colloidal form.

13. The method according to claim 2 wherein the copper phosphate is added to the bath as an aqueous solution of copper phosphate in a slight stoichiometric excess of orthophosphoric acid and the pH of the bath is raised by the addition of an alkaline material to a point sufficient to form colloidal copper phosphate and exhausting the colloidal copper phosphate onto the nylon.

14. As an article of manufacture a nylon textile treated by the method of any of claims 1 to 13.

15. Dyed nylon textile fiber carrying, in addition to any copper that may have been incorporated in the fiber during its manufacture, at least 3 parts per million colloidal copper phosphate (based on the fiber weight).

16. Nylon textile fiber carrying, in addition to any copper incorporated in the fiber during its manufacture, at least 3 parts per million colloidal copper phosphate (based on the fiber weight).

17. Nylon textile fiber carrying from about 3 to 7500 parts per million colloidal copper phosphate (based on the weight of the fiber).

18. Nylon textile fiber carrying from about 3 to 1500 parts per million colloidal copper phosphate (based on the fiber weight).

19. A fiber according to claim 17 or claim 18 also carrying a dye.

* * * * *

UNITED STATES PATENT AND TRADEMARK OFFICE

CERTIFICATE OF CORRECTION

PATENT NO. : 4,253,843

DATED : March 3, 1981

INVENTOR(S) : Vincent W. Bannigan, Jr.

It is certified that error appears in the above—identified patent and that said Letters Patent is hereby corrected as shown below:

At Column 2, line 20, after "above" add the word --about--.

At Column 4, lines 43 through 48 inclusive, change Claim 7 to read (the bracketing indicating deletions and new material being underscored):

--7. The method according to Claim 2 wherein the copper phosphate is applied by passing the textile fibers through an aqueous bath containing the copper phosphate and after the fibers have passed through the bath subjecting [heating and] the wetted fibers to heating under time and temperature conditions sufficient to cause the copper phosphate to penetrate beneath the surface of the fibers.--

Signed and Sealed this

*Third* Day of *August 1982*

[SEAL]

*Attest:*

GERALD J. MOSSINGHOFF

*Attesting Officer*

*Commissioner of Patents and Trademarks*